US010123614B2

(12) United States Patent
Trujillo

(10) Patent No.: US 10,123,614 B2
(45) Date of Patent: Nov. 13, 2018

(54) CONCEALED SHELF

(71) Applicant: John Trujillo, El Cajon, CA (US)

(72) Inventor: John Trujillo, El Cajon, CA (US)

( * ) Notice: Subject to any disclaimer, the term of this patent is extended or adjusted under 35 U.S.C. 154(b) by 0 days.

(21) Appl. No.: 15/151,842

(22) Filed: May 11, 2016

(65) Prior Publication Data

US 2017/0156493 A1 Jun. 8, 2017

Related U.S. Application Data

(60) Provisional application No. 62/261,997, filed on Dec. 2, 2015.

(51) Int. Cl.

| | |
|---|---|
| ***A47B 46/00*** | (2006.01) |
| ***A47B 96/02*** | (2006.01) |
| ***A47K 10/18*** | (2006.01) |
| ***A47B 3/00*** | (2006.01) |
| ***A47B 5/00*** | (2006.01) |

(52) U.S. Cl.

CPC ..... *A47B 46/00* (2013.01); *A47B 3/00* (2013.01); *A47B 5/00* (2013.01); *A47B 5/006* (2013.01); *A47B 96/025* (2013.01); *A47K 10/18* (2013.01); *A47K 2201/02* (2013.01)

(58) Field of Classification Search

CPC . A47B 46/00; A47B 96/027; A47B 2021/066; A47B 3/00; A47B 13/081; A47B 5/006; A47B 1/00; A47B 2021/068; A47B 5/04; A47B 19/08; A47B 1/05; A47B 3/083; A47B 77/10; A47B 7/02; A47B 5/02; A47B 3/002; A47B 5/00; A47B 13/16; A47B 2003/0835; A47B 83/045; A47B 96/025; A47K 10/18; A47K 2201/02; B64D 11/0638; B64D 11/0605; A47C 9/06; A47C 7/70

USPC ..... 108/33, 65, 69, 34, 35, 37, 38, 39, 40, 108/41, 42; 297/145; 211/87.01, 88.01, 211/88.02, 90.01, 119.003; 312/240–242, 312/306, 312, 246

See application file for complete search history.

(56) References Cited

U.S. PATENT DOCUMENTS

| | | | | | |
|---|---|---|---|---|---|
| 7,789 | A | * | 11/1850 | Shoenberger | A47B 1/08 108/93 |
| 69,799 | A | | 10/1867 | Greene | |
| 1,433,897 | A | * | 10/1922 | McGowan | D06F 81/06 108/37 |
| 1,516,763 | A | * | 11/1924 | Dexter | A47B 77/10 297/119 |
| 1,525,678 | A | * | 2/1925 | Wasmuth | A47C 9/06 108/38 |
| 1,583,280 | A | * | 5/1926 | Cummings | A47B 5/04 108/33 |
| 1,642,125 | A | * | 9/1927 | Nelson | A47C 9/06 108/38 |
| 1,684,193 | A | * | 9/1928 | Noack | E06B 3/385 108/38 |
| 1,902,319 | A | * | 3/1933 | Bloedel | A47B 67/02 312/235.4 |

(Continued)

*Primary Examiner* — Hiwot E Tefera

(74) *Attorney, Agent, or Firm* — Franco De Liguori; DP IP Group

(57) ABSTRACT

Disclosed is a shelf with a housing having a hollow interior and a tray having a plurality of surfaces, wherein the tray is in communication with the hollow interior of the housing, a holder is attached to the shelf one or more electrical outlets, which are electrically connected to a power source.

20 Claims, 4 Drawing Sheets

(56) References Cited

U.S. PATENT DOCUMENTS

| | | | | | |
|---|---|---|---|---|---|
| 2,330,627 | A * | 9/1943 | Reynolds | A47C 7/70 | 297/145 |
| 2,845,113 | A | 7/1958 | Keel | | |
| 2,963,078 | A * | 12/1960 | Ferrelle | B60N 3/004 | 108/38 |
| 3,583,760 | A | 6/1971 | McGregor | | |
| 5,050,929 | A * | 9/1991 | Gueringer | A47C 7/70 | 297/145 |
| 5,707,126 | A * | 1/1998 | Neufeld | A47B 5/00 | 108/37 |
| 7,201,439 | B2 | 4/2007 | Schweizer | | |
| 7,407,237 | B2 * | 8/2008 | Bright | A47B 67/02 | 312/242 |
| 7,628,439 | B1 * | 12/2009 | Strong | B62D 33/0273 | 108/44 |
| 8,100,062 | B1 * | 1/2012 | Anghel | A47B 1/05 | 108/69 |
| 8,763,537 | B2 * | 7/2014 | Ng | A47B 5/006 | 108/35 |
| 9,345,320 | B2 | 5/2016 | Calderone | | |
| 2004/0070319 | A1 * | 4/2004 | Miller | A47B 21/0314 | 312/208.1 |
| 2007/0095769 | A1 * | 5/2007 | Jenkins | A47K 10/38 | 211/119.009 |
| 2008/0042004 | A1 * | 2/2008 | Byrd | A47K 10/3836 | 242/560.3 |
| 2009/0078169 | A1 * | 3/2009 | Osborne | A47B 5/006 | 108/40 |
| 2014/0084640 | A1 * | 3/2014 | Walker | A47C 9/06 | 297/14 |
| 2014/0102337 | A1 * | 4/2014 | Ralph | A47B 37/04 | 108/25 |

* cited by examiner

CONCEALED SHELF

CROSS-REFERENCE TO RELATED APPLICATION(S)

The present application claims priority to U.S. Provisional Patent Application No. 62/261,997 filed on Dec. 2, 2015, entitled "Concealed Shelf System" the entire disclosure of which is incorporated by reference herein.

BACKGROUND OF THE INVENTION

1. Field of Invention

The present invention relates to the field of fixtures, more particularly space-saving and folding shelves and surfaces.

2. Description of Related Art

As the population continues to increase, increasing the efficient use of space is required. Family sizes may become larger and while the size of a standard home may decrease. Specifically, the decrease in home size includes a decrease in available space for fixtures, furniture, and surfaces to place objects on. For example, a bathroom is generally a smaller room is a home and to save on space, pedestal sinks are installed without any surface area to place cosmetics and toiletries.

Often, people will try to place objects on the rim of a sink, which will result in the object falling into the sink or onto the floor. Perfumes, colognes, and other cosmetics or toiletries are made of glass or fragile containers that will be damaged from the fall. Electronics placed on the edge of a sink may also be damaged from impacting the floor, or from falling into a sink with water. This presents a danger to the user as electrical contact with water can be extremely dangerous and result in electrocution of the user. When toiletries such as toothbrushes make contact with the floor, there is an increased risk of contacting bacteria and other microorganisms that may be harmful to the user.

Currently, there are very few options that allow for increased surface area without sacrificing a large amount of space. A vanity or cabinet may have a sink installed on the countertop, but this defeats the purpose of trying to save space. Medicine cabinets may be used to store toiletries and cosmetics, but they are limited in size and prevent the accessibility offered by a counter top surface. People may install shelves extending outwardly from the wall, near the sink. However, this is a permanent fixture that may not take up floor space, but it does intrude into the functional space of the room.

Based on the foregoing, there is a need in the art for cost effective, efficient, space-saving, device that can be engaged when necessary, then put away when not in use. A device that will allow people the freedom of increased surface area for their items without the potential for danger or damage.

SUMMARY OF THE INVENTION

A shelf comprising a housing having a hollow interior, wherein the housing attaches to a surface; and a tray in communication with the housing, wherein in a first position the tray is concealed within the housing, and wherein in a second position the tray is retracted from the housing.

In an embodiment, the one or more apertures extend through the tray.

In an embodiment, The shelf has one or more tracks in communication with an interior surface of the housing and the tray, wherein the one or more tracks facilitate operation of the tray.

In an embodiment, the one or more electrical outlets are attached to the housing.

In an embodiment, The shelf has at least one holder attached to the shelf.

In an embodiment, the at least one holder is attached to a front side of the housing.

In an embodiment, the at least one holder is attached to a bottom surface of the tray.

In an embodiment, the tray has one or more extension segments.

In an embodiment, the one or more extension segments are telescopic relative to one another.

In an embodiment, the one or more extension segments are hingedly attached to one another.

In an alternative embodiment, a shelf has a housing having a hollow interior, wherein the housing attaches to a surface; a tray in communication with the housing, wherein in a first position the tray is concealed within the housing, and wherein in a second position the tray is retracted from the housing; a holder attached to the shelf; and one or more electrical outlets electrically connected to a power source.

In an embodiment, the one or more electrical outlets are attached to the housing.

In an embodiment, the plurality of surfaces are telescopic relative to each other.

In an embodiment, the holder comprises a bar that receives a roll of paper.

In an embodiment, the tray comprises one or more extension segments.

In an embodiment, the one or more extension segments are telescopic relative to one another.

In an embodiment, the one or more extension segments are hingedly attached to one another.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
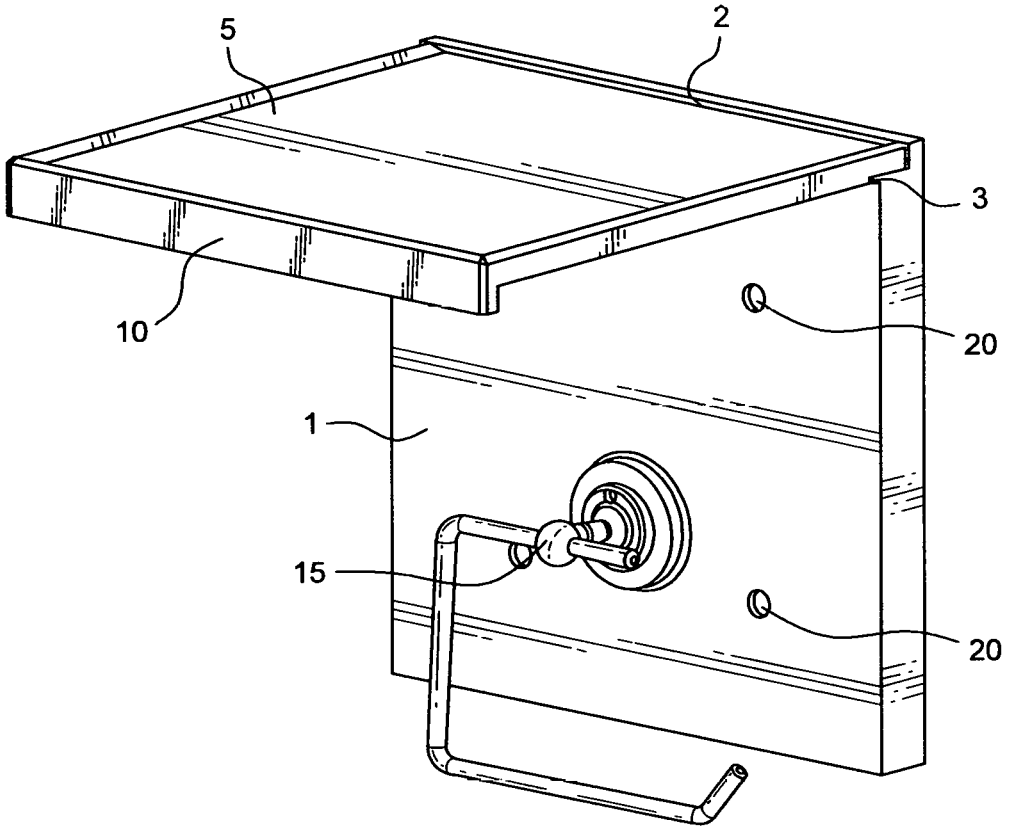
FIG. 1 is a perspective view of the concealed shelf in an open position, according to an embodiment of the present invention.

Preferred embodiments of the present invention and their advantages may be understood by referring to FIGS. 1-5, wherein like reference numerals refer to like elements.

In an embodiment, FIG. 1 shows a concealed shelf 10 in an open position having a folding shelf or tray 5 with a top surface, a bottom surface (not shown), a first side, and a second side. The second side engages a housing 1 having a face, backside (not shown), and at least one sidewall. The housing 1 has a cavity defined by an interior surface of the face, backside, and at least one sidewall for receiving the shelf or tray 5. The cavity generally extends into the housing and is configured to accept the tray in a closed position.

In an embodiment, the backside of the housing is separate from the sidewalls. The backside can be mounted to a surface and the sidewalls and face can attach to the mounted backside.

In an embodiment, the second side of the tray 5 has at least one wheel (not shown) where the wheel is configured to engage the cavity of the housing. In an alternative embodiment, the wheels operate within a track (not shown) to facilitate the movement of the tray 5 into and out of the cavity, such that the tray does not bump the sides of the cavity.

In another embodiment, the tray 5 has one or more peripheral edges and the housing cavity has an interior with a plurality of surfaces. When the tray 5 is in the concealed position, one or more of the peripheral edges are in close proximity with one or more of the interior surfaces of the cavity. These peripheral edges in close proximity are attached to a track to facilitate the sliding engagement of the tray 5 to the housing 1 or housing cavity.

In another embodiment, the housing 1 has a lip 2 generally perpendicular from the backside, extending outwardly from the backside towards the face. The lip 2 partially covers the opening of the cavity between the backside and the face of the housing 1. When the tray 5 is pulled out of the cavity, in the open position, the top surface of the second side of the tray 5 engages the lip 2 of the housing 1 while the bottom surface of the tray 5 includes a notch 3 that engages the housing 1 and acts as a fulcrum while the lip 2 prevents the second side of the tray 5 from flipping up beyond an open position. The tray 5 is cantilevered outward from the housing 1. In an alternative embodiment, the housing 1 has a cap adapted to cover the open side of the housing. The cap is used to close the opening to the housing cavity such that it will prevent debris or fluids from entering the housing cavity.

In an embodiment, the tray 5 is removably attached to the cavity of the housing 1. When a user grabs the tray to pull the tray 5 out of the housing 1 into the open position, the tray 5 can be completely separated from the housing 1. The tray 5 can then be used as a separate surface to rest objects on away from the housing 1.

In another embodiment, the track is crimped at the open end of the housing 31 cavity where the tray 5 extends. The crimp in the track prevents the wheels from continuing beyond the length of track and acts to hold the tray 5 in the open position while the point where the face contacts the bottom surface of the tray acts as a fulcrum point.

In an embodiment, the first side 10 of the tray 5 has a handle 13 that extends outwardly therefrom. The handle 13 allows a user to easily grab the first side of the tray 5 when pulling the tray 5 out of the housing cavity. In an alternative embodiment, the tray 5 has a channel (not shown) in close proximity to the first end 10 of the tray 5 to allow the user easily hold the tray 5 when pulling the tray 5 out of the housing cavity.

In another embodiment, the tray 5 has at least one pivot point where a pin (not shown) extends from the interior surface of the face of the housing, through the tray 5, and into the interior surface of the backside of the housing 1. The tray 5 is then pivotally removed from the housing 1 through a sidewall.

In an embodiment, the top surface of the tray 5 textured such that the texture will prevent objects placed thereupon from slipping. In an alternative embodiment, the top surface of the tray 5 has a non-slip coating.

In an embodiment, the tray 5 has a plurality of regions. The regions are configured to hold an otherwise maintain objects. For example, the end of the tray 5 has a region with at least one aperture 9 extending from the top surface through to the bottom surface where the apertures 9 are of various size to accommodated toothbrushes, hair dryers, hair straighteners, curling irons, shaving razors, etc. In another embodiment, a region of the tray has one or more depressions 8 to accommodate small objects and prevent them from being easily knocked off of the tray 5. In an alternative embodiment, the regions are separate sections that releasably engage the first side of the tray 5. Clips, fasteners, or screws are examples of attachment mechanisms to attach the releasbly region to the front side 10 of the tray 5.

In another embodiment the concealed shelf has multiple trays within the housing. Each tray may be supported within the housing by sliding tracks or sliding brackets. In an alternative embodiment each of the trays are removably engaged with the housing.

In an embodiment, the tray 5 is lifted out of the housing and laid in an open position where foldable supports extend from the bottom of the tray 5. The foldable supports unfold from the bottom of the tray 5 and when the tray 5 is removed from within the housing 1. A side of the foldable support extends outward from the bottom of the tray 5 and engages the face of the housing to support the tray 5 in an open position. The combined weight of the tray 5 and items (not shown) placed on the tray 5 is thereby transferred to the face of the housing through the support.

Figure 2:
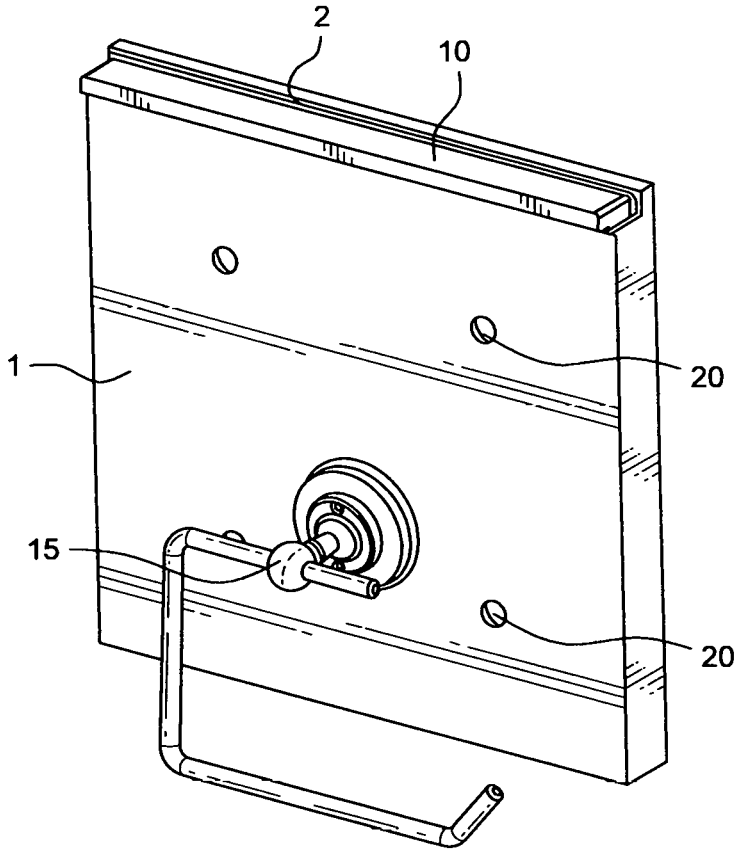
FIG. 2 is a perspective view of the concealed shelf in a closed position, according to an embodiment of the present invention.

In an embodiment, FIG. 2 shows the tray 5 in a closed position within the housing 1. The first side 10 of the tray 5 extends slightly out of the housing 1, such that it may be pulled from the housing 1 by the first side 10.

In an embodiment, the concealed shelf has a holder 15 for personal hygiene tissue, toilet paper, a towel, or cloth on the holder 15 to allow for readily accessible use. The holder 15 is attached to the housing 1 and extends outwardly from the face of the housing 1. The holder 15 has a holder base that is attached to the face of the housing 1 with at least one generally cylindrical rod that extends outwardly from the holder base. The rod is generally, bent at a right angle and then extends from the bend parallel to the face of the housing 1.

In an alternative embodiment, the holder 15 has a base with a generally cylindrical rod in an annular shape where a first end of the rod extends outward from the base in an annular direction such that the first end connects back to the base at a second point forming a loop.

In an embodiment, the concealed shelf 10 has a mount (not shown). A first end of the mount attaches to the backside of the housing 1 and extends outwardly therefrom. A second end of the mount is configured to engage a surface. For example, the second end of the mount may engage a wall where the mount is attached to the wall extending the concealed shelf 10 outwardly from the wall. In an alternative embodiment, the second end of the mount is configured to engage the pedestal of the sink (not shown). The mount has generally annular clamps that will engage the external circumference or surface of the pedestal of the sink allowing the concealed shelf to be installed on the pedestal sink and extend outwardly past the outer diameter of the sink rim. In an alternative embodiment, the mount can removably engage a surface where the mount does not require penetration of the surface. Adhesives are installed on the second end of the mount and the second end of the mount is configured to removably adhere to the surface. Another example if at least one suction cup on the second end of the mount that can adhere to a flat surface using the vacuum suction of the suction cups on the mount.

In an embodiment, the concealed shelf system 100 is installed on a bathroom vanity. The vanity has one or more surfaces where the backside of the housing 1 is attached to at least one of the surfaces of the vanity. In another embodiment, when the tray 5 is pulled from the housing 1, the tray 5 surface is coplanar with a sink surface or usable surface of the vanity.

In an embodiment, the concealed shelf 100 is attached to a surface using at least one sliding clip (not shown). The backside of the housing and the mounting location have corresponding parts of the sliding clip. The housing 1 can slideably engage the sliding clip as an attachment to a surface.

In another embodiment, the concealed shelf has at least one mounting hole 20 in the face of the housing and the backside (not shown) of the housing. The mounting hole 20 in the face of the housing 1 is larger that the mounting hole in the backside of the housing 1 such that a user is able to access a screw or other attachment device extending through the mounting hole of the backside. The mounting hole of the backside is small to allow the shank of a screw or mounting device to pass through, but small enough to be held in place by the head of the screw.

In use, the concealed shelf is installed on a surface in a desired location. A user then grabs the first side 10 of the tray 5 exposed through the housing 1. The user then pulls the tray 5 in a general upward direction and outwardly from the housing cavity. When the user has pulled the majority of the tray 5 out of the housing, the tray 5 is pulled outwardly in a decreasing angle, pivoting along the edge of the housing 1, towards a parallel position with the floor of the room in an embodiment. The tray 5 will then rest in a level position relative to the floor of the room held at the second edge by the lip 2 of the housing 1 and the notch 3 engaging the housing 1. Objects can then be placed on the top surface of the tray 5 and used as needed. In an alternative embodiment, at least on foldable support will extend outwardly from the bottom surface of the tray 5 and support the tray 5 against the face of the housing 1 in a level position relative to the floor of the room. In another embodiment, the tray 5 has a handle 13, such as a bar, for the user to hold onto as the pull the tray 5 from the housing 1.

When the user no longer requires objects to be placed on the tray 5, the first side of the tray 5 is lifted upward relative to the floor, from the level position. When the tray 5 is lifted the second side of the tray 5 will begin to enter the housing cavity. The user continues to lift the tray 5 in an upward direction while simultaneously lowering the tray 5 into the housing cavity. The tray 5 continues into the housing cavity until it rests on the bottom of the cavity only the first side 10 of tray 5 is exposed from the housing 1.

In an embodiment, the concealed shelf 100 provides rerouted electrical power. In one embodiment, the housing 1 has one or more electrical outlets 30. In another embodiment, the tray 5 surface has one or more electrical outlets 30. In yet another embodiment, the tray 5 and housing 1 each comprise one or more electrical outlets 30. The conceal shelf has a power source such as a battery holder to accept one or more batteries. The one or more batteries are in electrical communication with the one or more electrical outlets 30. In an embodiment, at least one electrical out 30 has one or more universal serial bus (USB) connection ports. In another embodiment, the connection ports of the electrical outlet 30 are configured and adapted to provide power for an electrical device.

In an alternative environment, the concealed shelf 100 is electrically connected into an existing electrical infrastructure of the structure to which is it installed. In this embodiment, the one or more electrical outlets 30 are in communication with one or more electrical leads that extend beyond the housing 1 to allow a user, during installation, to connect the electrical leads to existing electrical wiring within the structure.

In another embodiment, the one or more electrical outlets 30 are in communication with one or more electrical leads extending beyond the housing 1. The terminal end of the electrical leads is a plug adapted to plug into an electrical outlet existing in/on the structure to which the concealed shelf is installed. In this embodiment, the concealed shelf acts to extend the capabilities of existing outlet capabilities of the room. For example, the concealed shelf is installed and the plug is inserted into an existing electrical outlet of the structure. The electricity travels through the electrical leads to supply the one or more electrical outlets 30 of the concealed shelf with power to be used by the user.

Figure 4:
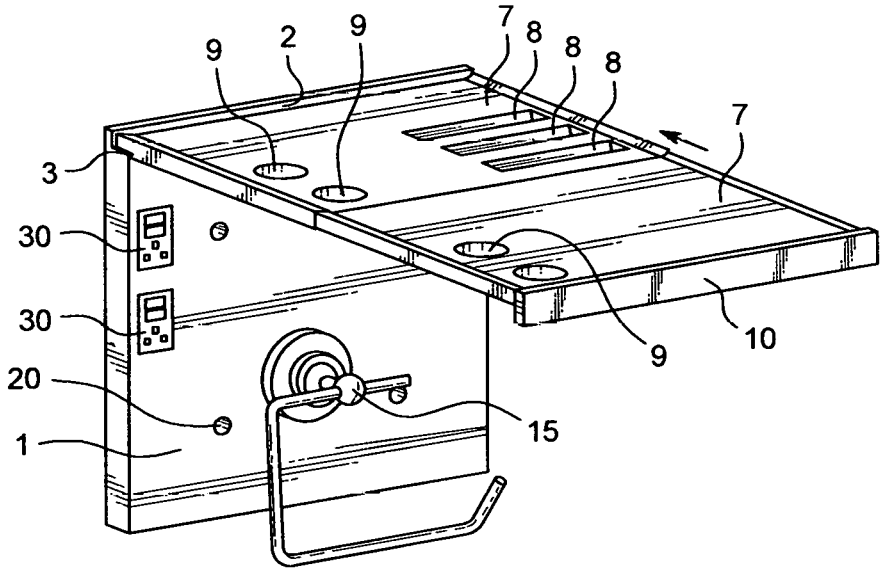
FIG. 4 is a perspective view of the concealed shelf, according to an embodiment of the present invention.

In an alternative embodiment, FIG. 4 illustrates the concealed shelf having a telescoping tray 7 having multiple sections contained within one another. The first side 10 of the outermost tray section is exposed, slightly above the housing cavity, when the telescoping tray 7 is in a concealed position allowing tactile access to extracting the telescoping tray 7 from the cavity. Sections of the tray may include a first section located nearest to the housing and, in an embodiment, this is the section to remain in contact with the housing when the tray is in the open position. There may be a plurality of intermediate sections between the first section and the outermost section. Each section of the telescoping tray 7 has a sectional upper surface, a sectional bottom surface, and one or more sidewalls extending from the sectional bottom surface to the sectional upper surface. Each section further comprises an interior cavity defined by an interior surface of each sectional surface. The cavity is configured to accept subsequent sections of tray 7 where a subsequent section of telescoping tray 7 extends from the sectional cavity, when in use, and matingly engages the same cavity when in a concealed position. Each section of the telescoping tray 7 surface also has a means for preventing subsequent sections from being completely removed. For example, a means for preventing subsequent section from being completely removed is a clip or protrusion in communication with each subsequent tray section, whereby the clip or protrusion is adapted to engage subsequent tray sections thereby preventing the subsequent sections from being severed from the complete tray.

In another embodiment, the outermost section has one or more attachment components adapted to attach each section of the telescoping tray 7 to one another. For example, an attachment component is a clip, spring-biased button, magnetic connection, or a wire traveling through either tray section where the wire allows individual movement for each of the telescoping tray 7 sections until fully extended and the wire becomes taught.

In an embodiment, when the telescoping tray 7 is in the concealed position, each section of the tray surface telescopically engage one another reducing the overall surface area of the tray. This reduced surface area tray is then slid into the housing cavity. In this embodiment, the telescoping tray 7 allows for a reduced size of the housing 1 to accommodate a reduced telescopic tray 7 surface.

In an alternative embodiment, the concealed shelf has a multi-sectional tray with one or more sections in communication with one another allowing the one or more section to fold or slide onto one another. In this embodiment, a user is able to adjust the physical surface area of the tray by folding or slide sections of the tray onto one another where the tray surface area is reduced as the tray is folded or slid onto another section.

Figure 3:
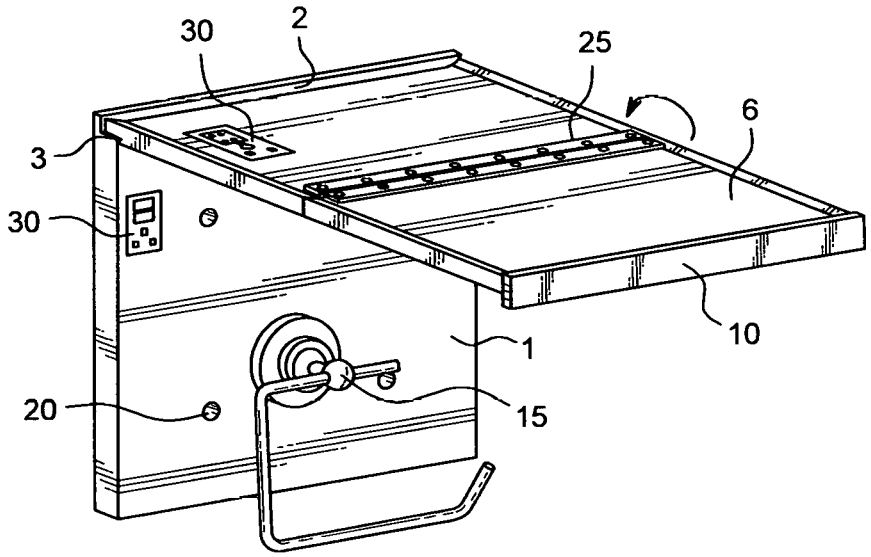
FIG. 3 is a perspective view of the concealed shelf, according to an embodiment of the present invention.

In another embodiment, FIG. 3 illustrates a concealed shelf wherein each section 6 of the folding or sliding tray surface are attached to one another. The attachment for a folding shelf surface is one or more hinge style attachments. For example, a first section of the tray is located farthest from the housing when the tray is in an open position. This first section has a proximal side connected to a side of a hinge 25. Another side of the hinge 25 is attached to a distal side of the second section of the tray. When a reduced tray surface area is required, the first section of the tray is folded onto the second section of the tray. In another embodiment, each section of the tray surface slides onto one another. For example, each section tray has one or more pivot points where two sections of surface connected by a pivot pin are capable of rotating relative to one another thereby reducing the surface area of the tray surface.

Figure 5:
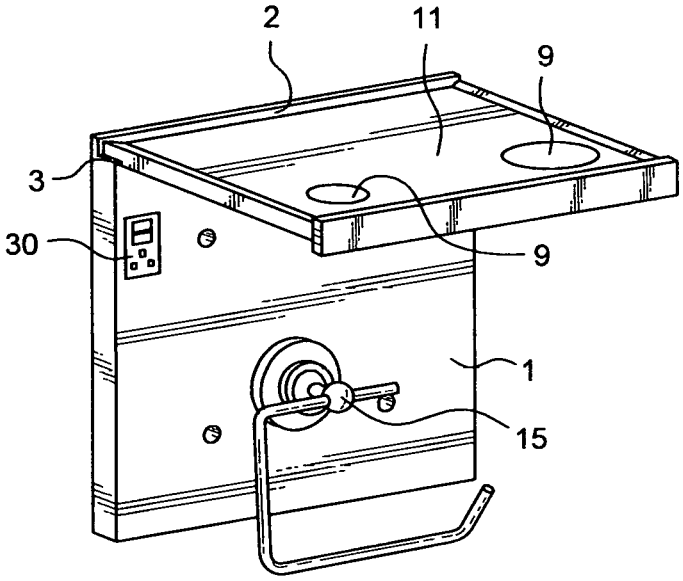
FIG. 5 is a perspective view of the concealed shelf, according to an embodiment of the present invention.
Figure 6:
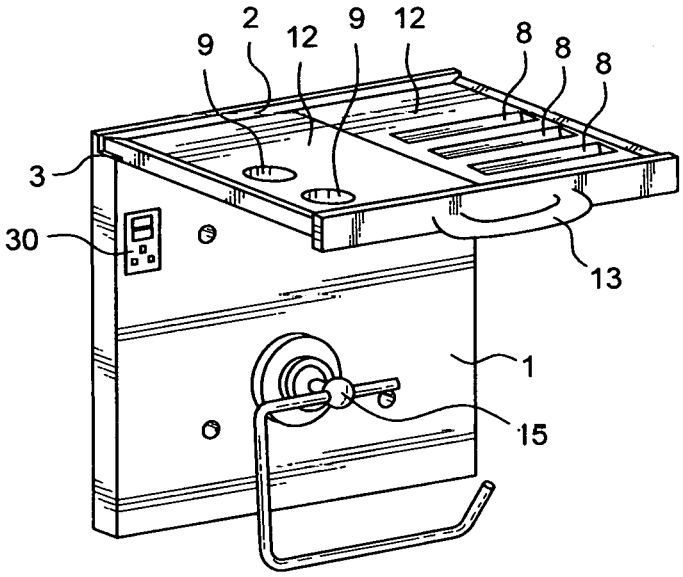
FIG. 6 is a perspective view of the concealed shelf, according to an embodiment of the present invention.

In an alternative embodiment, FIGS. 5-6 illustrate the concealed shelf having a tray 11 with an adaptable surface wherein at least one aperture 9 extends through the tray surface. In other embodiments, the tray surface has one or more depressions 8 extending into the tray surface 12. In an embodiment, the concealed shelf has a handle 13 in communication with the tray to facilitate transition of the concealed shelf from an open position to a close position.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A shelf comprising:

a housing configured to be releasably fixedly secured to an exterior surface of a structure, the housing having a face, a backside, at least one sidewall, a cavity defined by an interior surface of the face, the backside and the at least one sidewall, and a lip generally perpendicular from the backside and extending outwardly from the backside towards the face, the lip being disposed outside of the cavity and partially covering an opening of the cavity between the backside and the face;

a tray having a top surface, a bottom surface, a first side, a second side, and a notch formed in the bottom surface, the tray being configured to be placed in a first position relative to the housing in which the tray is removably inserted into and stored within the housing cavity and configured to be placed in a second position relative to the housing in which the tray is retracted from the housing cavity and connected to the housing in a cantilever fashion with no portion of the tray, including the second side, extending into the housing cavity; and one or more tracks in communication with an interior surface of the housing cavity and the tray, wherein the one or more tracks facilitate operation of the tray;

wherein in the first position the tray is stored within the housing cavity with at least the top and bottom surfaces and the second side of the tray being disposed entirely within the housing cavity so that they are not visible from the exterior of the housing; and wherein in the second position the top surface of the tray at the second side engages the lip of the housing to prevent the second side of the tray from flipping up while the notch formed in the bottom surface of the tray engages the housing and acts as a fulcrum.

2. The shelf of claim 1, wherein one or more apertures extend through the tray.

3. The shelf of claim 1, wherein one or more electrical outlets or one or more universal serial bus connection ports are attached to and accessible from the face of the housing.

4. The shelf of claim 1, further comprising a handle extending outwardly from the first side of the tray for removably inserting the tray within the housing cavity to position the tray in the first position and for retracting the tray from the housing cavity to position the tray in the second position.

5. The shelf of claim 1, further comprising at least one holder attached to the face of the housing and outside of the cavity.

6. The shelf of claim 5, wherein the at least one holder comprises a bar configured to receive and support a roll of paper.

7. The shelf of claim 1, wherein the tray comprises one or more extension segments.

8. The shelf of claim 7, wherein the one or more extension segments are telescopic relative to one another.

9. The shelf of claim 7, wherein the one or more extension segments are hingedly attached to one another.

10. The shelf of claim 1, further comprising at least one mounting hole formed in each of the face and backside of the housing configured to receive therethrough a mounting device for releasably fixedly securing the housing to the exterior surface of the structure.

11. The shelf of claim 1, wherein in the first position, the first side of the tray extends out of the cavity of the housing such that the tray may be pulled out from the first side and retracted from the cavity.

12. A shelf comprising:

a housing configured to be releasably fixedly secured to an exterior surface of a structure, the housing having a top end, a bottom end, a face and a backside extending from the top end to the bottom end, a pair of sidewalls interconnecting the face and backside in spaced-apart relation to one another from the top end to the bottom end, a cavity defined by interior surfaces of the face, backside and pair of sidewalls and having an opening at the top end, and a lip disposed generally perpendicular from the backside and extending outwardly from the backside towards the face, the lip being disposed outside of the cavity and partially covering the opening of the cavity between the backside and the face; and a tray having a top surface, a bottom surface, a first side, a second side configured to engage the lip of the housing, and a notch formed in the bottom surface and configured to engage the top end of the housing;

wherein the tray is configured to be placed in a first position relative to the housing in which the tray is removably inserted within the cavity via the opening at the top end of the housing with at least the top surface, bottom surface, and second side of the tray being disposed entirely within the cavity so that they are not visible from the exterior of the housing;

wherein the tray is configured to be placed in a second position relative to the housing in which the tray is completely retracted from the cavity of the housing with no portions of the tray extending into the cavity, the second side of the tray engages the lip of the housing, and the notch formed in the bottom surface of the tray engages the top end of the housing; and wherein the opening at the top end of the housing provides the only access for the tray into and out of the cavity of the housing.

13. The shelf of claim 12, further comprising one or more electrical outlets or one or more universal serial bus connection ports attached to and accessible from the face of the housing, the one or more electrical outlets being electrically connectable to a power source.

14. The shelf of claim 12, further comprising a holder mounted to the face of the housing and outside of the cavity for receiving and supporting a roll of paper.

15. The shelf of claim 12, wherein the tray comprises one or more extension segments.

16. The shelf of claim 15, wherein the one or more extension segments are telescopic relative to one another.

17. The shelf of claim 15, wherein the one or more extension segments are hingedly attached to one another.

18. The shelf of claim 12, further comprising at least one mounting hole formed in each of the face and backside of the housing configured to receive therethrough a mounting device for releasably fixedly securing the housing to the exterior surface of the structure.

19. The shelf of claim 12, wherein in the first position, the first side of the tray extends out of the cavity of the housing such that the tray may be pulled out from the first side and retracted from the cavity.

20. A shelf comprising:

a housing configured to be releasably fixedly secured to an exterior surface of a structure, the housing having a top end, a bottom end, a face and a backside extending from the top end to the bottom end, a pair of sidewalls interconnecting the face and backside in spaced-apart relation to one another from the top end to the bottom end, a cavity defined by interior surfaces of the face, backside and pair of sidewalls and having an opening at the top end, and a lip disposed generally perpendicular from the backside and extending outwardly from the backside towards the face, the lip being disposed outside of the cavity and partially covering the opening of the cavity between the backside and the face;

means for releasably fixedly securing the housing to the exterior surface of the structure;

a tray configured to be selectively inserted into and removed from the cavity of the housing, the tray having a top surface, a bottom surface, a first side, a second side configured to engage the lip of the housing, and a notch formed in the bottom surface and configured to engage the top end of the housing; and means for selectively inserting the tray into the cavity of the housing and removing the tray from the cavity of the housing;

wherein the tray is configured to be placed in a first position relative to the housing in which the tray is inserted into the cavity via the opening at the top end of the housing with at least the top surface, bottom surface, and second side of the tray being disposed entirely within the cavity so that they are not visible from the exterior of the housing; and wherein the tray is configured to be placed in a second position relative to the housing in which the tray is completely removed from the cavity of the housing with no portions of the tray extending into the cavity, the second side of the tray engages the lip of the housing, and the notch formed in the bottom surface of the tray engages the top end of the housing.

* * * * *